United States Patent [19]

Dobias

[11] 4,338,834

[45] Jul. 13, 1982

[54] WRENCH

[76] Inventor: John J. Dobias, 1212 Sumach Dr., Windsor, Ontario, Canada, N8S 2S4

[21] Appl. No.: 168,374

[22] Filed: Jul. 10, 1980

[51] Int. Cl.[3] ..... B25B 13/28

[52] U.S. Cl. ..... 81/106

[58] Field of Search ..... 81/100, 106, 107, 109, 81/110

[56] References Cited

U.S. PATENT DOCUMENTS

| | | | |
|---|---|---|---|
| 542,265 | 7/1895 | Klose | 81/110 |
| 751,342 | 2/1904 | Ruggles | 81/106 |
| 1,207,334 | 12/1916 | Shostrom | 81/107 |

FOREIGN PATENT DOCUMENTS

| | | | |
|---|---|---|---|
| 945724 | 12/1948 | France | 81/110 |
| 118190 | 2/1947 | Sweden | 81/107 |

*Primary Examiner*—James G. Smith

*Attorney, Agent, or Firm*—Whittemore, Hulbert & Belknap

[57] ABSTRACT

A wrench comprising a gripping member, a handle having a complementary gripping portion at one end thereof, structure for adjusting the gripping member with respect to the gripping portion axially of the handle without rotating the handle relative to the gripping member, and structure pivotally mounting the gripping member on the adjusting structure. The gripping member may have a 60° or 90° included angle or may be arcuate with a gripping surface extending over substantially 180°. In one modification, the structure for adjusting the gripping member is rack and gear, while in another modification, it is screw and nut.

7 Claims, 15 Drawing Figures

FIG. 4
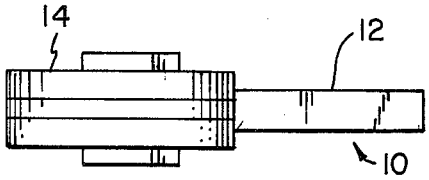
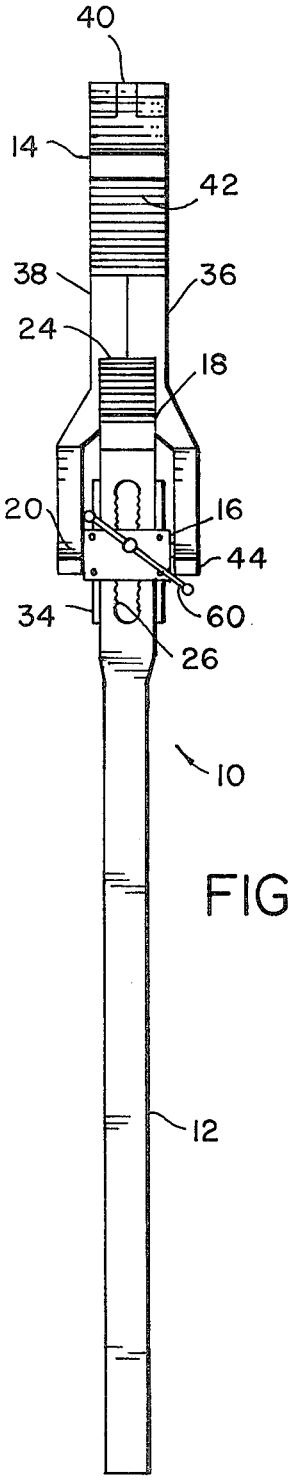
FIG. 3
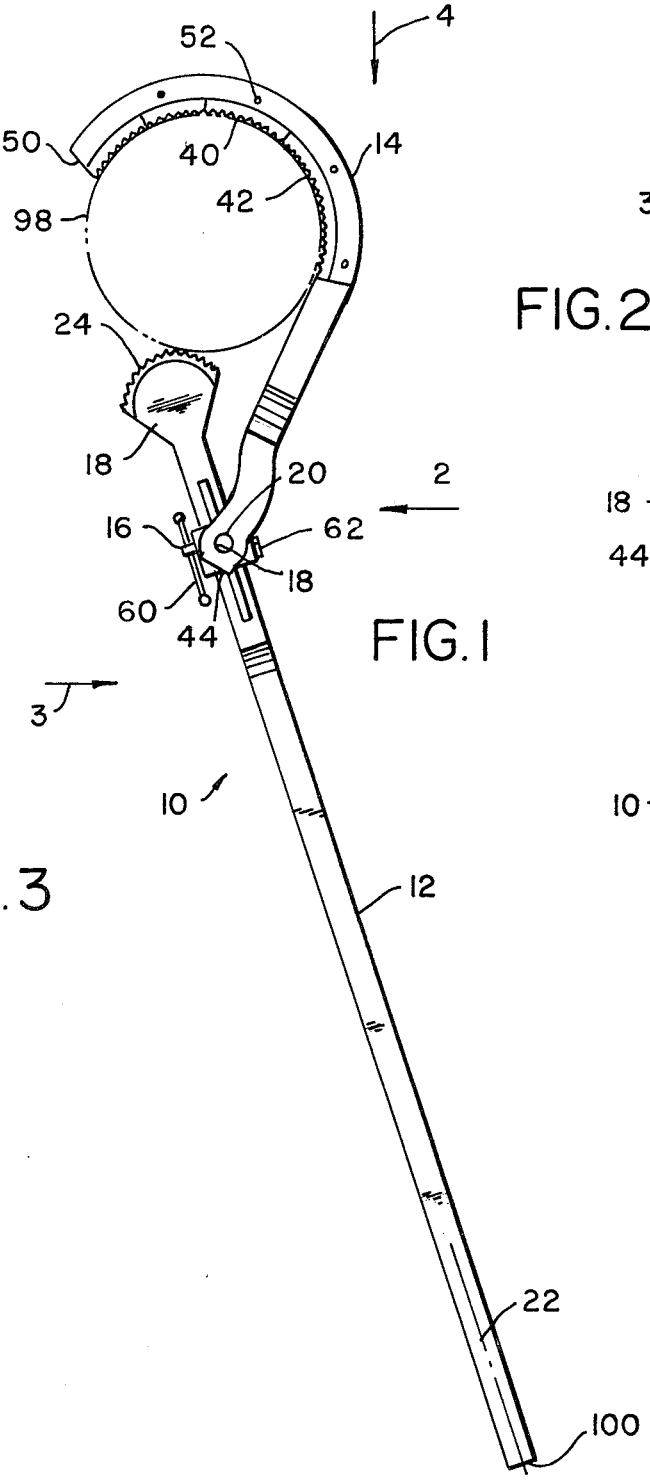
FIG. 1
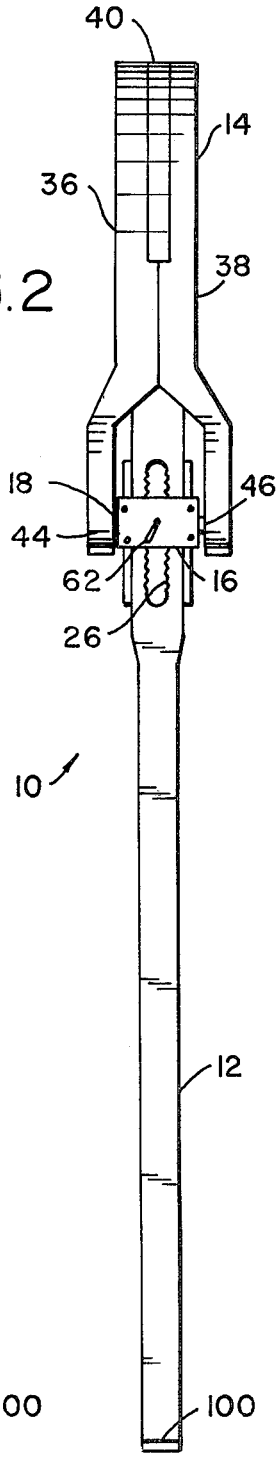
FIG. 2

FIG.11
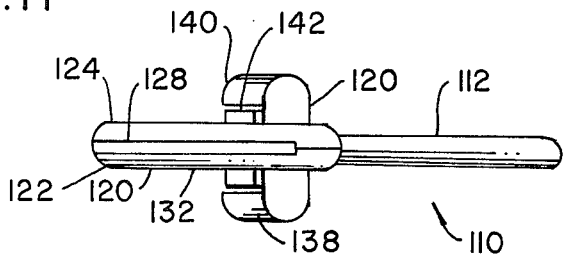
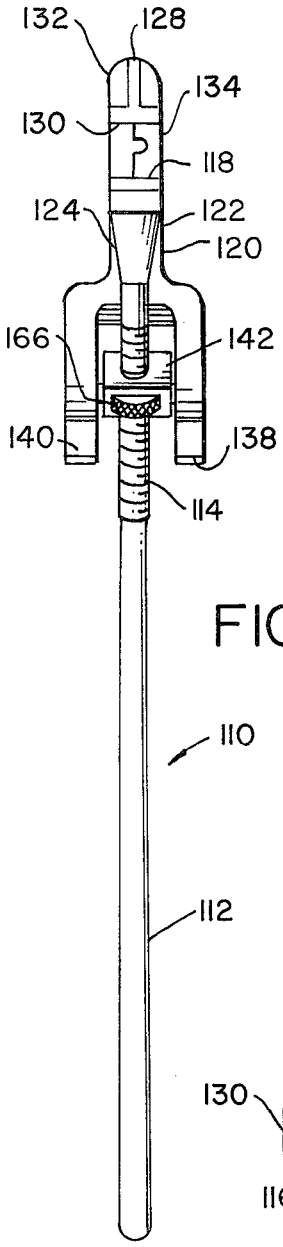
FIG.10
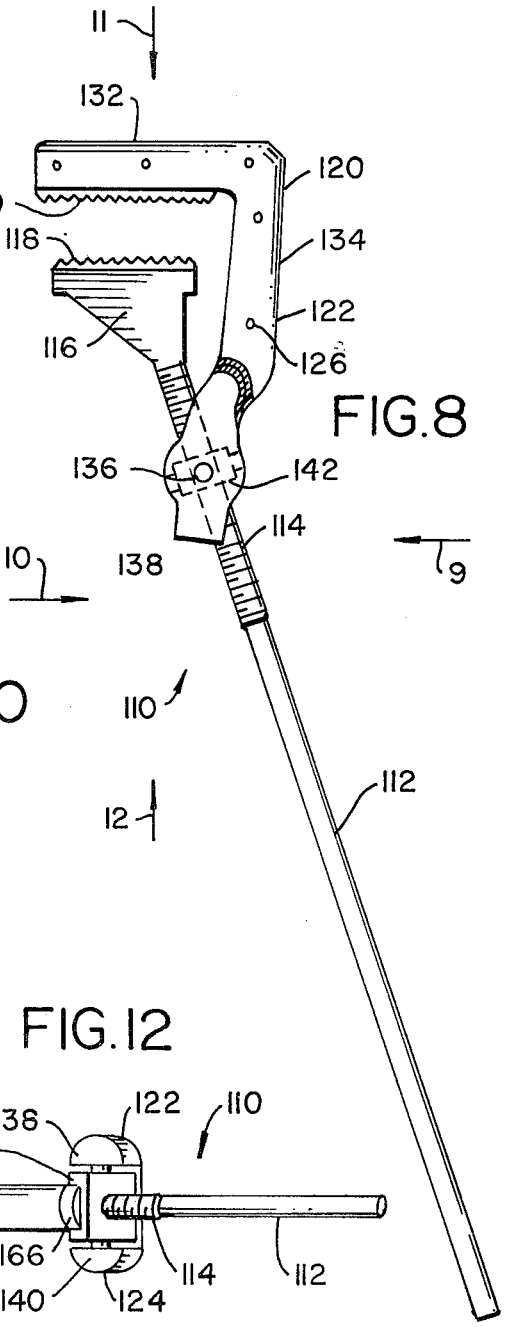
FIG.8
FIG.9
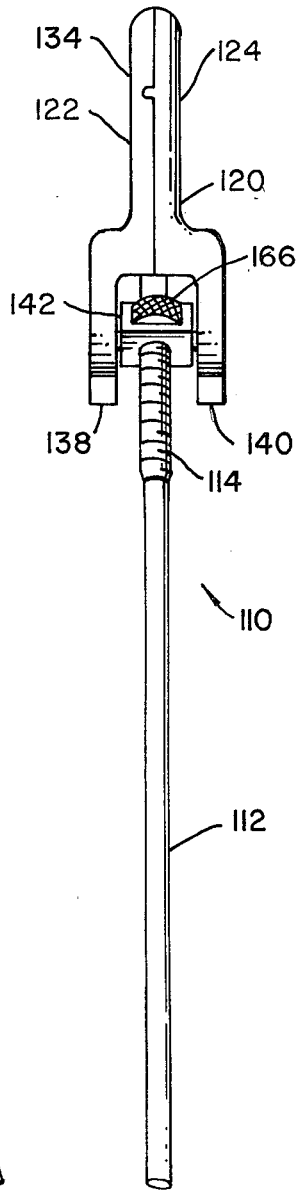
FIG.12
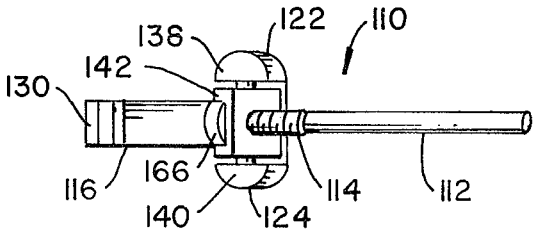

WRENCH

BACKGROUND OF THE INVENTION

1. Field of the Invention

The invention relates to wrenches and refers more specifically to an improved wrench for use on pipes or the like, including a handle having a gripping portion on one end thereof, a gripping member, means for axially adjusting the gripping member with respect to the gripping portion on the handle, and means for pivotally mounting the gripping member on the handle through the means for axially adjusting the gripping member.

2. Description of the Prior Art

In the past, pipe wrenches and the like have been substantially rigid devices wherein the gripping member is permitted only minor movement with respect to the handle. With such devices of the past, adjustment has normally been by moving a gripping member substantially axially of the handle. Such devices often produce insufficient gripping and are often difficult to engage with the member it is desired to apply torque to and to adjust.

SUMMARY OF THE INVENTION

In accordance with the present invention, a wrench particularly suitable for applying torque to cylindrical items such as pipes and the like, but in modified form equally adaptable to applying torque to objects having flat surfaces such as nuts or the like, is disclosed. The wrench of the invention includes a gripping member, which may have an arcuate gripping surface extending over substantially 180°, or the gripping member may be V or L shaped having two leg portions with an included angle of 60° or 90°. The wrench of the invention further includes a handle having a gripping surface on one end thereof complementary to the gripping surface on the gripping member, and means for moving the gripping member axially of the handle without rotating the handle relative to the gripping member and means for pivotally mounting the gripping member on the handle through the means for adjusting the gripping member axially.

In one modification, the means for axially adjusting the gripping member relative to the handle comprises rack and gear means operable between the handle and gripping member. In another modification of the invention, the means for adjusting the handle axially with respect to the gripping member comprises nut and thread means operable between the handle and adjusting means.

BRIEF DESCRIPTION OF THE DRAWINGS

FIG. 1 is an elevation view of a wrench constructed in accordance with the invention.

FIG. 2 is a rear view of the wrench of FIG. 1, taken substantially in the direction of arrow 2 in FIG. 1.

FIG. 3 is a front view of the wrench in FIG. 1, taken substantially in the direction of arrow 3 in FIG. 1.

FIG. 4 is a top view of the wrench illustrated in FIG. 1, taken substantially in the direction of arrow 4 in FIG. 1.

FIG. 8 is an elevation view of a modification of the wrench illustrated in FIG. 1.

FIG. 9 is a rear view of the wrench illustrated in FIG. 8, taken substantially in the direction of arrow 9 in FIG. 8.

FIG. 10 is a front view of the wrench illustrated in FIG. 8, taken substantially in the direction of arrow 10 in FIG. 8.

FIG. 11 is a top view of the wrench illustrated in FIG. 8, taken substantially in the direction of arrow 11 in FIG. 8.

FIG. 12 is a bottom view of the wrench illustrated in FIG. 8, taken substantially in the direction of arrow 12 in FIG. 8.

DESCRIPTION OF THE PREFERRED EMBODIMENTS

Figure 5:
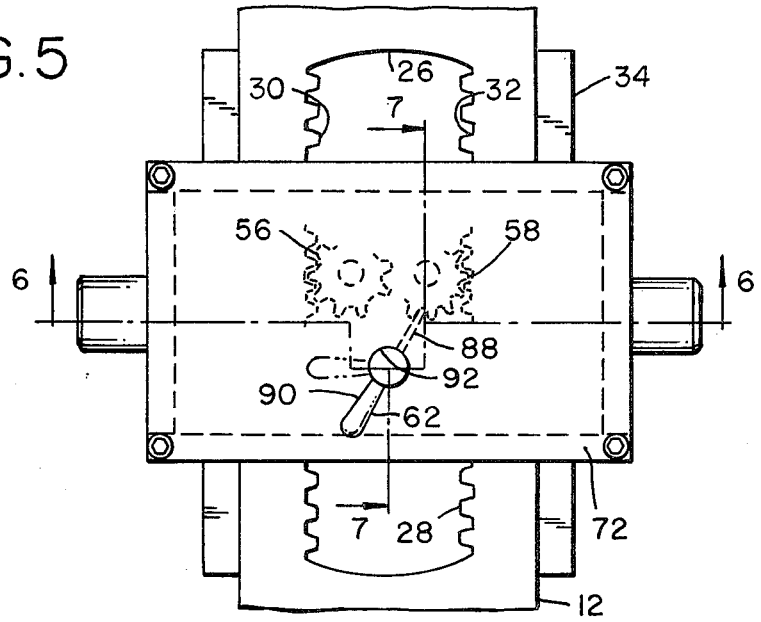
FIG. 5 is an enlarged view of a portion of the wrench illustrated in FIG. 1, similar to a portion of FIG. 3.

The wrench 10 illustrated in FIGS. 1–7 includes a handle 12, a clamping member 14, means 16 for moving the clamping member 14 axially of the handle 12, and means 20 for pivotally mounting the clamping member 14 on the handle 12 through the means 16 for axially adjusting the clamping member.

More specifically, the handle 10 is generally rectangular in cross section and has a longitudinal axis 22. The end 18 of the handle 12 is enlarged as shown best in FIG. 1 and has a gripping surface 24 thereon. The surface 24 may be manufactured integrally with the handle 12 or may be a separately manufactured gripping member secured to the end 18 of the handle 12 by convenient means such as screws and/or adhesive.

A slot 26 is provided in the handle 12. The slot 26 includes rack teeth 28 on the opposite longitudinal sides 30 and 32 thereof, as best shown in FIG. 5. Axially extending guide fins 34 are provided on the handle 12 in the area of the slot 26 for guiding the handle 12 axially through the means 16 for adjusting the gripping member 14 relative to the handle 12, as will be seen subsequently. The guide fins 34 are generally rectangular in cross section.

The gripping member 14 includes the separate body side parts 36 and 38 and the central member 40 having the gripping surface 42 thereon. The side parts 36 and 38 are constructed, as shown, to provide a bifurcated end 44 including openings 46 extending therethrough into which pivot bosses 48 of the pivot means 20 extend with the wrench 10 assembled.

With the side parts 36 and 38 of the gripping member 14 in assembly, the end 50 thereof is also bifurcated and receives the central member 40 which is secured thereto by convenient means such as bolts 52. The central member 40 of the gripping member 14, as shown best in FIG. 3, has a T-shape cross section and extends over an arc of substantially 180°.

Figure 6:
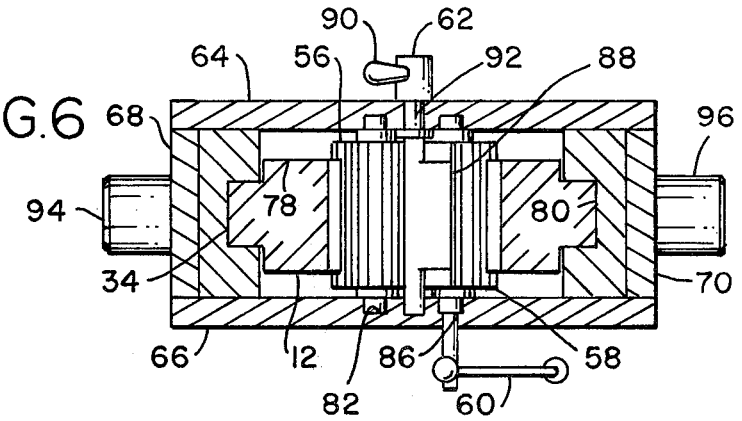
FIG. 6 is a section view of the portion of FIG. 3 illustrated in FIG. 5, taken substantially on the line 6—6 in FIG. 5.
Figure 7:
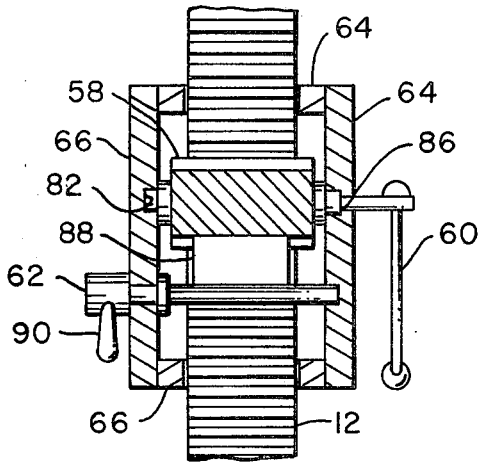
FIG. 7 is a section view of the portion of FIG. 8 illustrated in FIGS. 5 and 6, taken substantially on the line 7—7 in FIG. 6.
Figure 13:
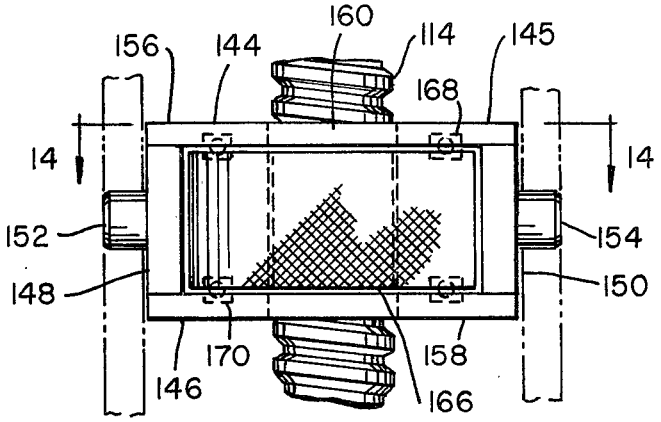
FIG. 13 is an enlarged section view of a portion of the wrench illustrated in FIG. 8, taken substantially on the line 13—13 in FIG. 14.
Figure 14:
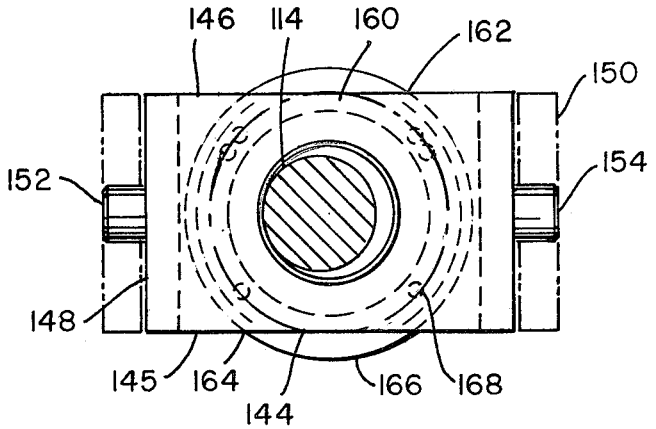
FIG. 14 is an enlarged section view of a portion of the wrench shown in FIG. 8, taken substantially on the line 14—14 in FIG. 13.

The means 16 for moving the gripping member 14 axially of the handle 12 without twisting the handle 12 with respect to the gripping member 14, as best shown in FIGS. 5–7, includes the housing 54, the gears 56 and 58, the adjusting handle 60 and the lock 62. The housing 54 includes the front 64, back 66, ends 68 and 70, bottom 72, and top 74, constructed as shown and held together by convenient means such as bolts 76. It will be particularly noted that the bottom 72 and top 74 have slots 78 therein and guide slots 80 in the ends of the slots 78 for receiving the handle and guide fins 12 and 34 respectively of the wrench 10.

The gears 56 and 58 are rotatably mounted in bearing recesses 82 in the front and rear portions 64 and 66 of the housing 54, as shown best in FIG. 6. The gears 56 and 58 are meshed with each other and are meshed with the rack teeth 30 and 32 on the opposite sides of the slot 26.

The handle 60 is connected to the gear 58 through an opening 86 in the front 64 of the housing 54. Thus, on rotation of the handle 84 abut the axis of the gear 58, the gear 58 and therefore the gear 56 are caused to rotate to produce relative movement between the housing 54 and the handle 12 axially of the handle 12.

Lock 62 includes the locking finger 88 pivotally mounted in the housing 54 between the front 64 and back 66 thereof. The lock 62 further includes the lock actuating member 90 connected to the locking finger 88 through opening 92 in back 66 of the housing 54. As shown in FIG. 5, on rotation of the locking finger 88 counterclockwise into the position shown, rotation of the gear 58 in a clockwise direction is prevented. On rotation of the lock actuating member 90 clockwise out of engagement with the gear 58, rotation of the gear 58 in a clockwise direction is permitted. Similarly, on rotation of the lock actuating member 90 in a direction clockwise to the point where the locking member engages the gear 56, counterclockwise rotation of the gear 56 is prevented. If it is desired, any known detent or biasing mechanism may be used in conjunction with the lock actuating member 90 to cause the lock 62 to remain in either locking position or an unlocking neutral position.

The means 20 for pivotally mounting the gripping member 14 on the handle 12 through the means 16 includes the pivot bosses 94 and 96 on the opposite sides 68 and 70 of the housing 54 and the openings 48 in the ends 44 of the side members 36 and 38 of the gripping member 14.

With the wrench 10 constructed as above and assembled as shown in FIGS. 1–4, when it is desired to produce torque in a pipe or the like 98, shown in phantom in FIG. 1, the gripping member 14 may be placed on the pipe 98 with the gripping surface 42 in contact therewith. The axial position of the complementary end 18 of the handle 12 may then be adjusted by turning the handle 60 of the means 16 for adjusting the axial position of the gripping member 14 on handle 12 without rotation of the handle 12 to most advantageously place the gripping surface 24 on the end 18 of the handle 12 in engagement with the pipe 98. Clockwise movement of the end 100 of the handle 12 will then produce the desired torque in the pipe 98.

In the modified wrench structure 110 illustrated best in FIGS. 8–14, the handle 112 is round in cross section and is provided with a threaded portion 114 adjacent end 116 thereof and a gripping surface 118 is provided on the end 116 of the handle 112.

Again, the gripping member 120 is provided with a pair of body side parts 122 and 124 secured together by bolts 126. A central member 128 is also provided with a gripping surface 130 thereon. The gripping member 120 is substantially L-shape having the portions 132 and 134 making an angle of approximately 90° with each other. Bearing openings 136 are provided in the ends 138 and 140 of the body side members 122 and 124.

The means 142 for moving the gripping member 120 axially with respect to the handle 112, as best shown in FIGS. 13 and 14, again includes the housing 145 including front 144, back 146, ends 148 and 150 each having a bearing boss 152 and 154, respectively, thereon and the top 156 and bottom 158. The front and back of the body member 160 are provided with slots 162 and 164 therein through which the adjusting nut 166 extends, as shown.

The adjusting nut 166 has a knurled exterior surface and threadedly engages the threaded portion 114 of the handle 112. Nut 166 is held in position between the top and bottom 156 and 158 of the housing 145 by the annular bearings 168 and 170, respectively.

The operation of the modified wrench 112 is similar to the operation of the wrench 10 with the axial adjustment of the gripping member 120 being accomplished by the rotation of the nut 166 in the housing 160 while maintaining the handle 112 and the gripping member 120 against relative rotation.

Figure 15:
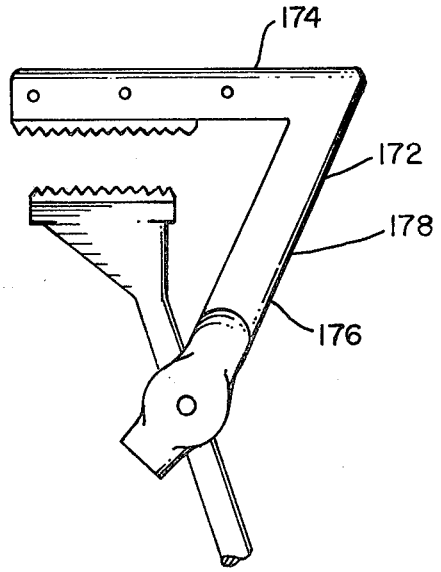
FIG. 15 is a partial elevation view of a portion of a further modification of the wrench illustrated in FIG. 8.

The modification 178 of the wrench 10, as shown in FIG. 15, includes a gripping member 172 which is substantially V-shape, has portions 174 and 176 forming an angle therebetween of approximately 60°. Other than the angle change in the gripping member 172, the wrench 178 is the same as the wrench 110 and operates in the same manner.

While one embodiment of the wrench of the invention, together with modifications thereof, have been considered in detail, it will be understood that other embodiments and modifications thereof are contemplated by the inventor. It is the intention to include all embodiments and modifications as are defined by the appended claims within the scope of the invention.

I claim:

1. A wrench comprising a gripping member, a handle having a gripping portion on one end thereof, means for moving the gripping member axially of the handle to vary the position of the one end of the handle with respect to the gripping member without rotating the handle with respect to the gripping member including a slot in the handle extending axially thereof having rack teeth on the axially extending sides thereof, a gear housing surrounding the handle at the slot therein, a pair of gears mounted in the housing and extending though the slot for rotation therein in engagement with each other centrally of the slot and each engaging a separate side of the slot with gear teeth meshed in the rack teeth, and means external of the housing for rotating at least one of the gears whereby the housing is moved axially of the handle, and means for pivotally securing the gripping member to the handle through the means for moving the gripping member axially of the handle.

2. Structure as set forth in claim 1, wherein the gripping member has an arcuate concave gripping surface extending through an arc of substantially 180°.

3. Structure as set forth in claim 1, wherein the gripping member is generally L-shape, includes a gripping surface on one portion and is connected to the handle at the outer end of the other portion thereof, said portions having an included angle of substantially 90° with respect to each other.

4. Structure as set forth in claim 1, wherein the gripping member is generally V-shape, includes a gripping surface on one portion and is connected to the handle at the outer end of the other portion thereof, said portions having an included angle of substantially 60° with respect to each other.

5. Structure as set forth in claim 1, wherein the means for pivotally securing the gripping member to the handle comprises pivot studs extending in opposite directions from the means for moving the gripping member axially of the handle and pivot openings in the gripping means for receiving the pivot studs therein.

6. Structure as set forth in claim 1, and further including means mounted on the gear housing for locking the gears against rotation within the gear housing.

7. Structure as set forth in claim 6, wherein the means for locking the gears against rotation in the gear housing comprises a pivotally mounted locking member within the housing and means external of the gear housing for pivotally moving the wedge locking member into and out of contact with at least one of the gears mounted in the housing.

* * * * *